United States Patent [19]

Wachtel

[11] Patent Number: 4,619,012

[45] Date of Patent: Oct. 28, 1986

[54] HAIRBRUSH

[75] Inventor: Jean-Louis Wachtel, Selestat, France

[73] Assignee: Celluloid S.A., France

[21] Appl. No.: 739,327

[22] Filed: May 30, 1985

[30] Foreign Application Priority Data

Feb. 27, 1985 [FR] France ..... 85 02860

[51] Int. Cl.[4] ..... A46B 9/00; A46B 9/08

[52] U.S. Cl. ..... 15/187; 15/159 A; 15/DIG. 5; 132/11 R; 132/85

[58] Field of Search ..... 15/186, 187, 188, 159 A, 15/DIG. 5; 132/11 R, 11 A, 85, 33 R, 39, 40

[56] References Cited

U.S. PATENT DOCUMENTS

| | | | |
|---|---|---|---|
| 3,459,199 | 8/1969 | Connell | 132/11 R |
| 4,267,851 | 5/1981 | Plaisted | 132/33 R |

FOREIGN PATENT DOCUMENTS

| | | | |
|---|---|---|---|
| 2401398 | 9/1974 | Fed. Rep. of Germany | 132/85 |
| 2604543 | 8/1977 | Fed. Rep. of Germany | 132/85 |
| 2622161 | 12/1977 | Fed. Rep. of Germany | 15/187 |
| 2649565 | 5/1978 | Fed. Rep. of Germany | 132/11 R |
| 2748171 | 5/1978 | Fed. Rep. of Germany | 132/85 |

*Primary Examiner*—Peter Feldman

*Attorney, Agent, or Firm*—Steinberg & Raskin

[57] ABSTRACT

A hairbrush having a head including a core portion on which is fixed an elongate hollow body including a certain number of strips arranged circumferentially at regular intervals and spaced from the core portion.

13 Claims, 7 Drawing Figures

X
X'
S1
S2
d

HAIRBRUSH

BACKGROUND OF THE INVENTION

Summary of the Invention

The present invention relates to a hairbrush for disentangling and drying wet hair.

There are known brushes used for that purpose, referred to as round brushes, of the type including a handle and a head extending in prolongation of the handle and from which bristles or pins serving to disentangle the wet hair extend radially outwardly.

However, such known brushes do not allow efficient drying of the disentangled hairs, especially when the latter are wound on the brush head.

The present invention has for a purpose to remedy the above drawback by providing a round hair-brush facilitating air circulation when used for hair drying.

To this end, the hairbrush of the present invention is characterized in that the brush head includes a core portion on which is fixed an elongate hollow body including a certain number of strips arranged circumferentially at regular intervals and spaced from the core portion so as to facilitate air circulation for drying the hair.

According to one feature of the invention, the brush also includes at least a plurality of small closed loops arranged at regular intervals along the aforesaid core portion and projecting between two mutually adjacent strips by a height greater than the distance between the said strips and the said core portion, so that two mutually adjacent loops retain the end of a hair tuft during the brushing.

According to still another feature of the invention, the aforesaid pins are arranged regularly along the aforesaid strips, with the said pins and loops in staggered arrangement.

According to still another feature of the invention, the aforesaid core portion, loops and handle, are made integral, preferably from a plastics material.

BRIEF DESCRIPTION OF THE DRAWINGS

For a fuller understanding of the invention, reference is made to the following description taken in connection with the accompanying drawings which illustrate one embodiment of the present invention, in which.

DESCRIPTION OF THE PREFERRED EMBODIMENT

Figures 1, 2, 3, 4, 5, 6, 7:
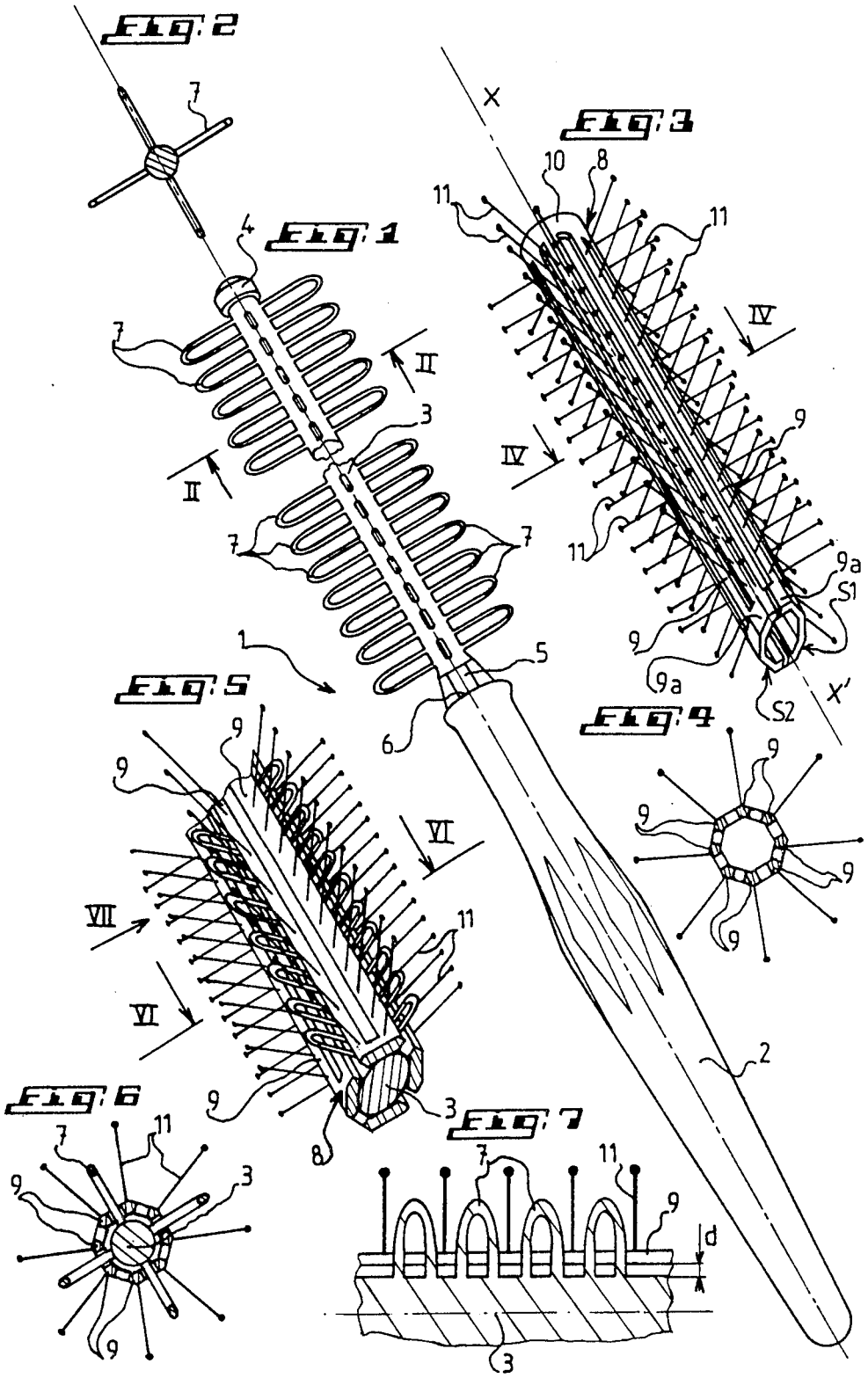
FIG. 1 is a perspective view of the support or mount of the brush of the invention.
FIG. 2 is a sectional view upon II—II of FIG. 1.
FIG. 3 is a perspective view of a body forming part of the head of the brush of the invention.
FIG. 4 is a sectional view upon IV—IV of FIG. 3.
FIG. 5 is a partial perspective view of the body shown in FIG. 3 fixed on the brush head core.
FIG. 6 is a sectional view upon VI—VI of FIG. 5.
FIG. 7 is a partially sectional view in the direction of arrow VII of FIG. 5.

Referring to the Figures, a brush according to the invention is constituted by a support or mount 1 including a solid handle 2 in prolongation of which extends a solid core portion 3.

The core portion 3, e.g. cylindrical in shape and circular in cross-section, is provided at its free end with a radially projecting portion or collar 4 connects with the handle 2 through the medium of another collar 5 abutting against a shoulder 6 of the handle. The core portion 3 also includes at least one set of a plurality of small closed loops 7 arranged at regular intervals along a generatrix of the core 3. In the case considered, the core portion 3 is provided with four sets of loops 7 arranged in stellate configuration whose branches are diametrically opposite in pairs. The adjacent loops of a same set are preferably flexible with respect to one another.

The mount 1 including the elements from 2 to 7 described above is made from any material, e.g. from a heat-resistant moulded synthetic resin.

The brush of the invention also includes an elongate hollow body 8 normally fixed on the core portion 3 as partially represented in FIG. 5. FIG. 3 shows the body 8 disconnected from the core portion 3 and which is defined by several straight strips 9 arranged circumferentially at regular intervals and connected at one of their ends to an annular ring 10. The ends 9*a* opposite the annular ring 10 of the strips 9 are partially connected together so as to define at least two sections of strips confronting one another. In the embodiment illustrated, the body 8 includes eight strips spaced circumferentially and defining two mutually confronting sections S1, S2 of four mutually adjacent strips, obtained by connecting together the four free ends 9*a* of the mutually adjacent strips. Otherwise stated, the two strip sections S1, S2 thus defined are arranged symmetrically on either side of a plane parallel to the strips and extending through the longitudinal axis X—X' of the body 8.

Moreover, pins or points 11 are arranged at regular intervals on each of the strips 9 and project radially outwardly in stellate configuration with eight branches diametrically opposite in pairs.

It should be noted that the collars 4 and 5 have outer surfaces of a shape mating to, respectively, the annular ring 10 and the inner shape of the opening defined by sections S1 and S2 and which may be, for example, octogonal.

The body 8 as described hereabove is made from any material, e.g. from a moulded heat-resistant synthetic resin. The brush head is formed by fitting and nesting the core portion 3 into the hollow body 8 which thus, when entirely mounted, bears upon the collars 4 and 5 through the medium of the annular ring 10 and the opposite octogonal opening, respectively. According to the invention, the strips 9 then extend in coaxial relationship to the core 3 and spaced from the latter a distance d clearly indicated in FIG. 7. The distance d is of course defined by the dimensional relation between the collars 4 and 5 and the diameter of the core 3. Moreover, each set of loops 7 projects through an aperture defined between two adjacent strips 9 by a height greater than the distance d. The points 11 and the loops 7 are in staggered arrangement.

FIG. 6 shows four sets of loops 7 projecting through the four corresponding apertures defined between two adjacent strips 9 and, in case the body 8 includes eight strips, four apertures are thus defined between two adjacent strips which are not traversed by the loops 7. However, it is obvious that there may be provided four other sets of loops diametrically opposite in pairs and extending through the free apertures, without departing from the scope of the invention.

When using the brush for hair drying, the pins 11 allow separating the hair into several tufts whose ends are retained by being caught between the adjacent flexible loops, which offers the advantage of facilitating the winding of the tufts onto the brush. Moreover, the space defined by the distance d between the strips 9 and the core 3 as well as the apertures offer the advantage of considerably facilitating the circulation of air for drying the hairs wound on the brush.

The body 8 can be removed from the core 3 when the user desires to clean the brush head, by moving the sections S1 and S2 from one another and withdrawing the support 1.

What is claimed is:

1. A hairbrush including a handle, a head extending in prolongation of said handle, and pins projecting from said head radially outwardly thereof for disentangling hair, wherein said head includes a core portion on which is fixed an elongate hollow body including a certain number of strips arranged circumferentially at substantially regular intervals and spaced from said core portion so as to facilitate the circulation of air for drying the hair, said pins being substantially arranged regularly along said strips, said hairbrush further comprising at least one plurality of small closed loops arranged at substantially regular intervals along said core portion and projecting between two adjacent strips by a height greater than the distance between the strips and the core portion so that two adjacent loops retain the end of a hair tuft during the brushing.

2. A hairbrush in accordance with claim 1, wherein said pins and loops are in staggered arrangement.

3. A hairbrush in accordance with claim 1, wherein said core portion, loops and handle are cast integral.

4. The hairbrush of claim 3, wherein said core portion, loops, and handle are cast from a plastics material.

5. A hairbrush in accordance with claim 4, wherein the aforesaid plastics material is a heat-resistant synthetic resin.

6. A hairbrush in accordance with claim 1, wherein said body and said pins are cast integral.

7. The hairbrush of claim 6 wherein said body and pins are cast from a plastics material.

8. A hairbrush in accordance with claim 7, wherein the aforesaid plastics material is a heat-resistant synthetic resin.

9. A hairbrush in accordance with claim 1, wherein said body is removable.

10. A hairbrush including a handle, a head extending in prolongation of said handle, and pins projecting from said head radially outwardly thereof for disentangling hair, wherein said head includes a core portion on which is fixed an elongate hollow body including a certain number of strips arranged circumferentially at substantially regular intervals and spaced from said core portion so as to facilitate the circulation of air for drying the hair, said pins being substantially arranged regularly along said strips, said hairbrush further comprising at least one plurality of small closed loops arranged at substantially regular intervals along said core portion and projecting between two adjacent strips by a height greater than the distance between the strips and the core portion so that two adjacent loops retain the end of a hair tuft during the brushing, and wherein said pins and loops are in staggered arrangement while said core portion, loops and handle are cast integral.

11. The hairbrush of claim 10, wherein said core portion, loops, and handle are cast from a plastics material.

12. A hairbrush including a handle, a head extending in prolongation of said handle, and pins projecting from said head radially outwardly thereof for disentangling hair, wherein said head includes a core portion on which is fixed an elongate hollow body including a certain number of strips arranged circumferentially at substantially regular intervals and spaced from said core portion so as to facilitate the circulation of air for drying the hair, said pins being substantially arranged regularly along said strips, said hairbrush further comprising at least one plurality of small closed loops arranged at substantially regular intervals along said core portion and projecting between two adjacent strips by a height greater than the distance between the strips and the core portion so that two adjacent loops retain the end of a hair tuft during the brushing, and wherein said pins and loops are in staggered arrangement.

13. A hairbrush including a handle, a head extending in prolongation of said handle, and pins projecting from said head radially outwardly thereof for disentangling hair, wherein said head includes a core portion on which is fixed an elongate hollow body including a certain number of strips arranged circumferentially at substantially regular intervals and spaced from said core portion so as to facilitate the circulation of air for drying the hair, said pins being substantially arranged regularly along said strips, said hairbrush further comprising at least one plurality of small closed loops arranged at substantially regular intervals along said core portion and projecting between two adjacent strips by a height greater than the distance between the strips and the core portion so that two adjacent loops retain the end of a hair tuft during the brushing, wherein said pins and loops are in staggered arrangement, said core portion, loops and handle are cast integral and from a plastics material, and wherein said plastics material is a heat-resistant synthetic resin.

* * * * *